United States Patent [19]

Bond

[11] Patent Number: 4,796,788

[45] Date of Patent: Jan. 10, 1989

[54] BAG-IN-BOX PACKAGING AND DISPENSING OF SUBSTANCES WHICH WILL NOT READILY FLOW BY GRAVITY

[75] Inventor: Curtis J. Bond, Longboat Key, Fla.

[73] Assignee: Liqui-Box Corporation, Worthington, Ohio

[21] Appl. No.: 89,653

[22] Filed: Aug. 26, 1987

[51] Int. Cl.[4] ..... B65D 35/22

[52] U.S. Cl. ..... 222/94; 222/95; 222/105; 222/386.5

[58] Field of Search ..... 222/386.5, 105, 106, 222/214, 183, 92, 94, 325, 95, 107; 383/906; 141/5, 114, 329

[56] References Cited

U.S. PATENT DOCUMENTS

| | | | |
|---|---|---|---|
| 2,930,423 | 3/1960 | Cunningham et al. | 222/94 |
| 2,991,916 | 7/1961 | Kish | 222/386.5 |
| 3,170,600 | 2/1965 | Pierson | 222/94 |
| 3,173,579 | 3/1965 | Curie et al. | 222/105 |
| 3,257,036 | 6/1966 | Micallef | 222/95 |
| 3,294,289 | 12/1966 | Bayne et al. | 222/95 |
| 3,300,102 | 1/1967 | Budzich | 222/386.5 |
| 3,377,766 | 4/1968 | Nelson | 53/27 |
| 3,590,888 | 7/1971 | Coleman | 141/5 |
| 3,802,470 | 4/1974 | Coleman | 141/5 |
| 3,838,794 | 10/1974 | Cogley et al. | 222/95 |
| 3,908,864 | 9/1975 | Copper | 222/105 |
| 3,945,534 | 3/1976 | Ady | 222/105 |
| 3,945,539 | 3/1976 | Sossong | 222/386.5 |
| 4,174,741 | 11/1979 | Parsons et al. | 141/2 |
| 4,256,150 | 3/1981 | Mockesch | 141/5 |
| 4,270,533 | 6/1981 | Andreas | 222/95 |
| 4,421,146 | 12/1983 | Bond et al. | 141/349 |
| 4,601,410 | 7/1986 | Bond | 222/92 |

FOREIGN PATENT DOCUMENTS

| | | | |
|---|---|---|---|
| 6602958 | 2/1966 | Netherlands | 222/94 |
| 247934 | 4/1947 | Switzerland | 222/386.5 |
| 998182 | 7/1965 | United Kingdom | 222/95 |
| 8204242 | 12/1982 | World Int. Prop. O. | 222/95 |

OTHER PUBLICATIONS

Battelle Memorial Institute, "Current" House Publication–vol. 18, #31, Aug. 7, 1987.

*Primary Examiner*—Kevin P. Shaver
*Assistant Examiner*—Kenneth Noland
*Attorney, Agent, or Firm*—William V. Miller; Sidney W. Millard

[57] ABSTRACT

Bag-in-box packaging of products which will not readily flow under gravity conditions for discharge. The bag is of special three-ply form to provide separate product and pressure chambers. Coupling fitments are connected independently to the respective chambers. When it is desired to dispense the product, the product fitment is exposed at a wall of the box along with the pressure fitment. A dispensing valve on the product fitment is opened and pressure is supplied and maintained in the pressure chamber to expand it and exert pressure through the baffle wall on the product in the product chamber to aid in the dispensing of the product therefrom. Before applying dispensing pressure, the box is disposed in an enveloping pressure-resisting unit. A novel method is provided for efficiently producing the special bag.

26 Claims, 6 Drawing Sheets

BAG-IN-BOX PACKAGING AND DISPENSING OF SUBSTANCES WHICH WILL NOT READILY FLOW BY GRAVITY

This application is copending with a related application, Ser. No. 89,642 filed Aug. 26, 1987.

FIELD OF THE INVENTION

This invention deals with the packaging and dispensing of aseptic or non-aseptic substances which will not readily flow by gravity, such as viscous and semi-viscous products or liquids with suspended solids, in a bag-in-box type package in which the product is in a disposable plastic bag enclosed in a protective fiberboard container. The packages could also be used for low viscosity products where the dispensing apparatus is remote and elevated above the package. As will later appear, the product is dispensed under pressure without passing through a pump. This would be particularly advantageous when handling aseptically processed and packed products, or e.g. diary products which are susceptible to bacterial spoilage. There would be no pump to dismantle and clean and no concern over contamination. For example, such products as aseptically packed juices or juice concentrate e.g. apple and orange, punches, bar mixes, etc. can be forced from the container at floor level to a dispenser at counter level.

In the following description, viscous or semi-viscous substances will be given as an example of products packaged and dispensed according to this invention, but as indicated, the invention is not limited to such products.

BACKGROUND OF THE INVENTION AND PRIOR ART

Bag-in-box packages have been in use for a number of years in packaging various products. One of the first of these packages used commercially is illustrated in U.S. Pat. No. 3,173,579. These packages have been used mainly for holding and dispensing liquids which will readily flow by gravity from the bag when the dispensing valve thereof is opened. However, they are not ordinarily used for containing and dispensing of substances which will not readily flow by gravity such as viscous and semi-viscous substances because of the requirement of special equipment, such as pumps, to dispense them.

SUMMARY OF THE INVENTION

The present invention deals with the combination of a novel disposable bag with the usual fiberboard box adapted to enclose and protect it. The baffle bag itself is of novel three-ply form, each ply consisting of one or more layers of mono- or multi-layer film. The middle or intermediate ply is a product baffle wall, the ply at the one side is the product outer wall and the ply at the other side is the displacement outer wall. Thus, there are two separate chambers produced in the bag, the one being the product-receiving chamber and the other being a pressure fluid-receiving chamber. Coupling fitments are provided on the bag in communication with the respective chambers for passing the product into and out of the product chamber and fluid under pressure into the opposed pressure chamber.

The bag is manufactured flat and the viscous or semi-viscous product is forced into the product chamber through its fitment and causes it to expand. The fluid-pressure chamber is not yet expanded and the displacement wall remains flat against the product baffle or barrier wall. In this condition, the filled bag is placed in a shipping container such as a box. To dispense the product, fluid-pressure is introduced into the pressure chamber of the bag and a valve on the product chamber is opened to permit forced dispensing. However, before this is done, the box is placed in a pressure-resisting enclosure, preferably in the form of a cage, since the dispensing pressure would otherwise cause bulging and eventual rupture of the box and subsequently the bag. The pressure is applied into the pressure chamber of the bag until the desired amount or all of the viscous or semi-viscous substance has been forced from the product chamber.

The product is likewise protected by the baffle ply from the fluid pressure being used to pressurize the bag. Relatively high pressures need not be used. Pressures 15 PSI or under are used according to this invention. A practical pressure range is 5 to 10 PSI, but in every case the pressure limit is determined by the strength of the "cage." Even here there is an upper limit somewhere between 10 and 15 PSI because the bag does not perfectly fill out the corners within the box and the result may be rupturing of the unsupported film.

The fitments for the two chambers could be on opposite sides of the bag, that is, on the other product wall and on the displacement outer wall as shown in copending application Ser. No. 89,642. However, in manufacturing the bag in a continuous strip it is desirable to have both fitments on the same side of the strip. This is accomplished according to this invention by having the product fitment on the product wall communicate directly with the product chamber and the pressure fitment next to it on the same wall but extending through the product wall to the intermediate baffle wall where it is sealed to be later pierced so it will be in direct communication with the pressure-filled chamber.

BRIEF DESRIPTION OF THE DRAWINGS

The best mode comtemplated in carrying out this invention is illustrated in the accompanying drawings in which.

DETAILED DESCRIPTION OF THE INVENTION

Figure 1:
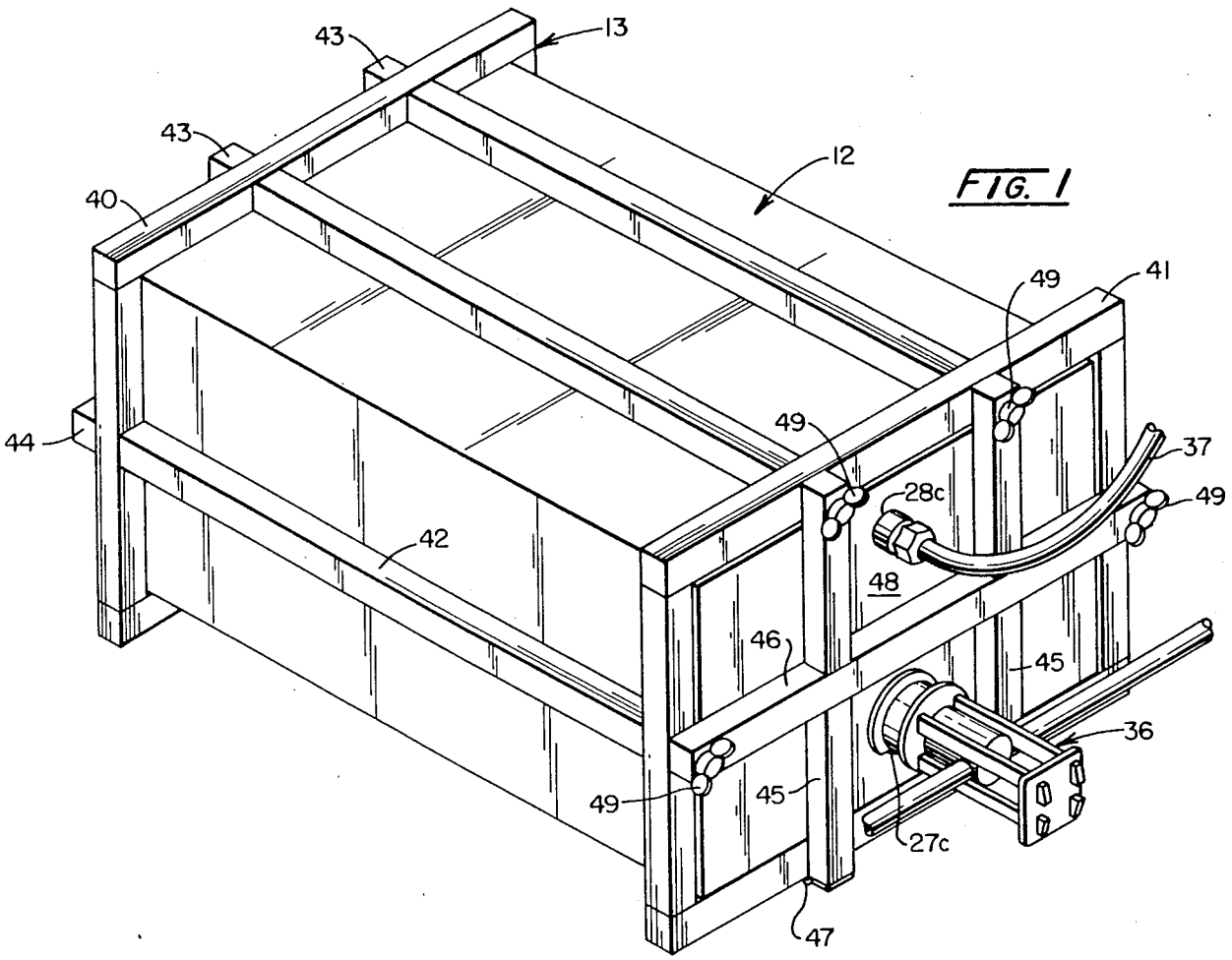
FIG. 1 is a perspective view showing the bag-in-box package of this invention disposed in a pressure-resisting cage for dispensing under pressure.
Figure 6:
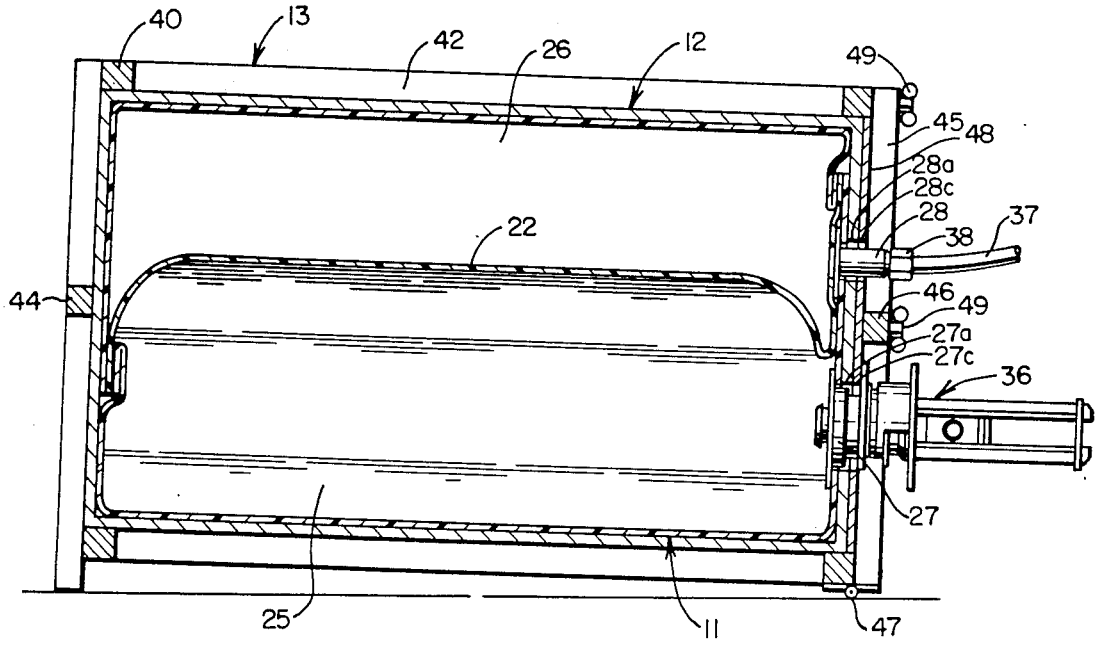
FIG. 6 is a sectional view showing the pressure chamber expanded to exert dispensing pressure on the filled product chamber with nearly one-half the product shown as remaining in the product chamber.
Figure 7:
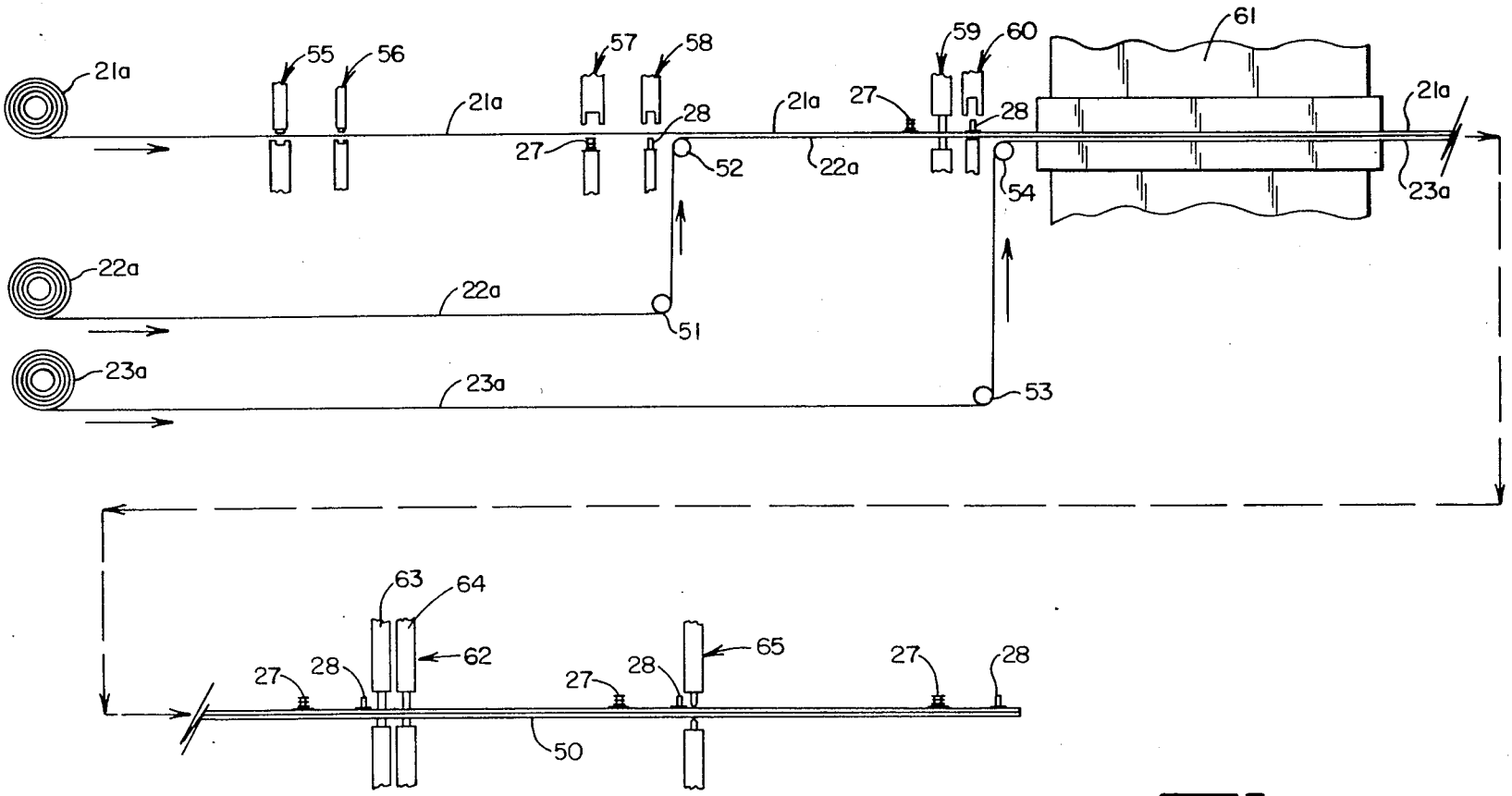
FIG. 7 is a schematic illustration of the method of producing a strip of the bags with the fitments on the same side of the strip.
Figure 7A:
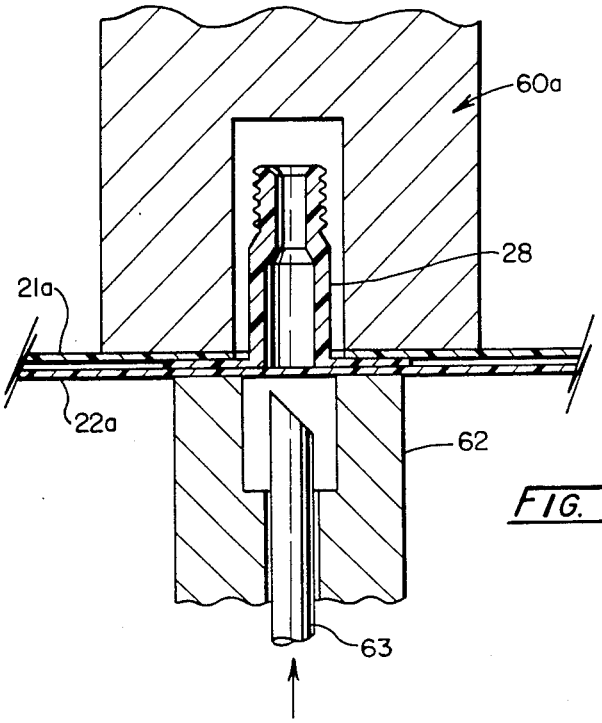
FIG. 7A is a schematic illustration of an optional means for piercing the seal at the inner end of the pressure fitting during bag manufacture.

As previously indicated, this invention comprises generally a novel three-ply bag shown at 11 (FIGS. 2 and 3), and at 11*b* (FIG. 8), a fiberboard box 12 (FIGS. 1 and 4 to 6) and a pressure-resisting cage 6 (FIGS. 1, 4 and 13) for receiving the box during the dispensing operation under pressure. In FIGS. 7 and 7A, the method of forming a strip of the bags is illustrated.

This invention deals with a bag-in-box type package which can be filled with viscous or semi-viscous substances or other substances that will not readily flow under gravity force when it is desired to dispense the substance. Various substances may be packaged in bulk according to this invention, including foodstuffs such as salad dressings, catsup, mustard, pizza sauce, etc., paints and glues, oils and grease and many other viscous or semi-viscous products, some of which may be processed and filled aseptically. According to this invention, the flow of the substance during dispensing is greatly aided by pressure on the product. This is accomplished according to this invention by using a disposable plastic bag made of three plies, mainly two outer plies and an intermediate baffle ply so as to provide separate independent product and pressure chambers in the bag.

Figure 2:
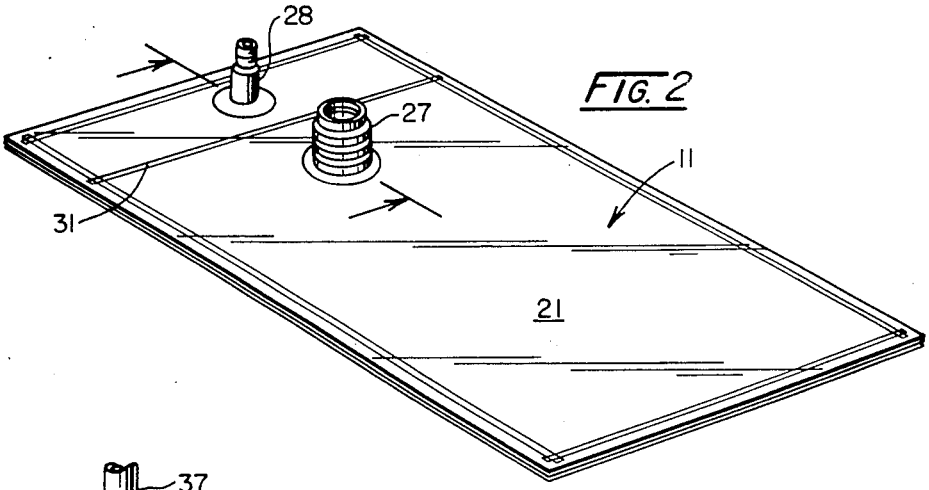
FIG. 2 is a perspective view of a plastic bag with coupling fitments on the same side in accordance with this invention.
Figure 3A:
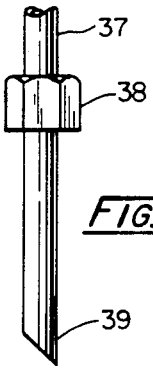
FIG. 3A is an elevational view showing a pressure coupling which will pierce the seal in the pressure fitment of the bag as it is coupled thereto.
Figure 3:
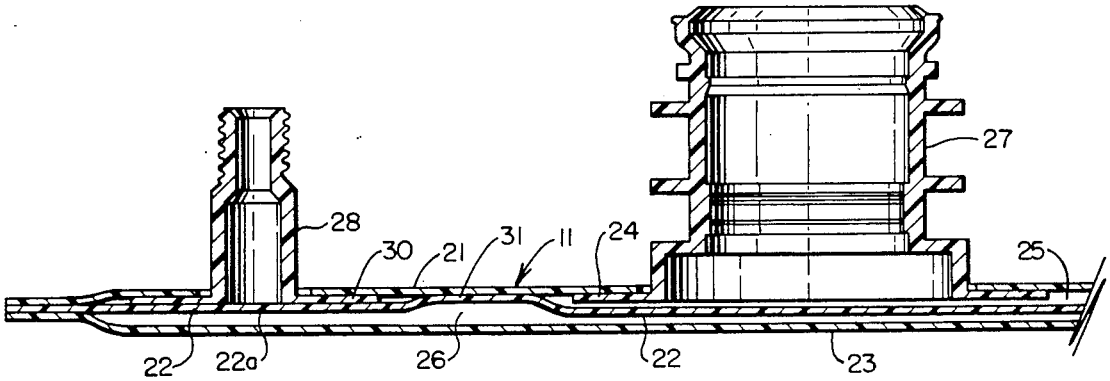
FIG. 3 is an enlarged sectional view taken along line 3—3 of FIG. 2 showing the fitments on the same side of the bag communicating with the respective chambers thereof.
Figure 4:
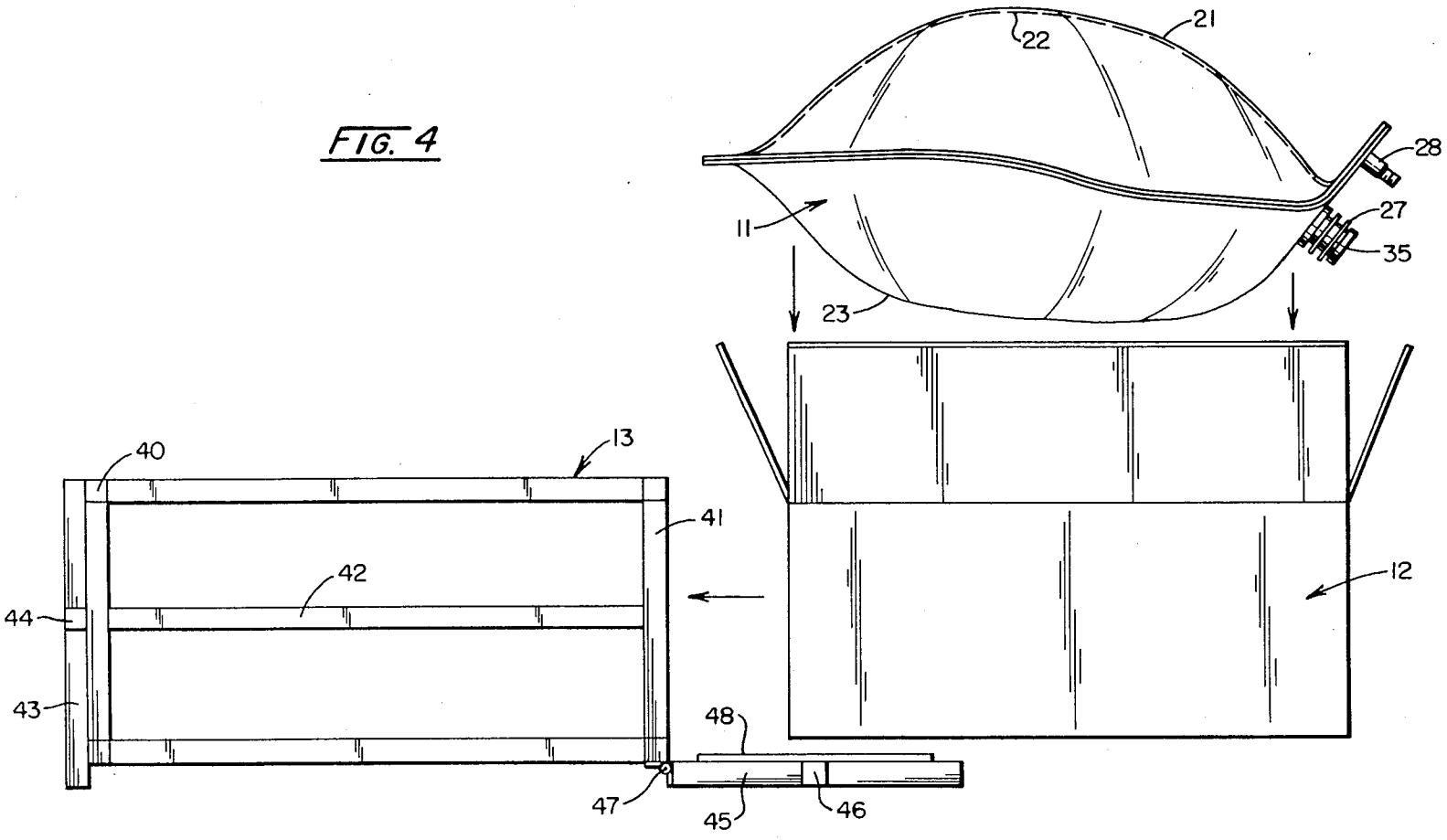
FIG. 4 is a schematic view showing the filled bag, a fiber box in which it may be packed and the pressure-resisting cage into which the box may be placed during dispensing, but it is to be understood that the operations are conducted seperately.
Figure 5:
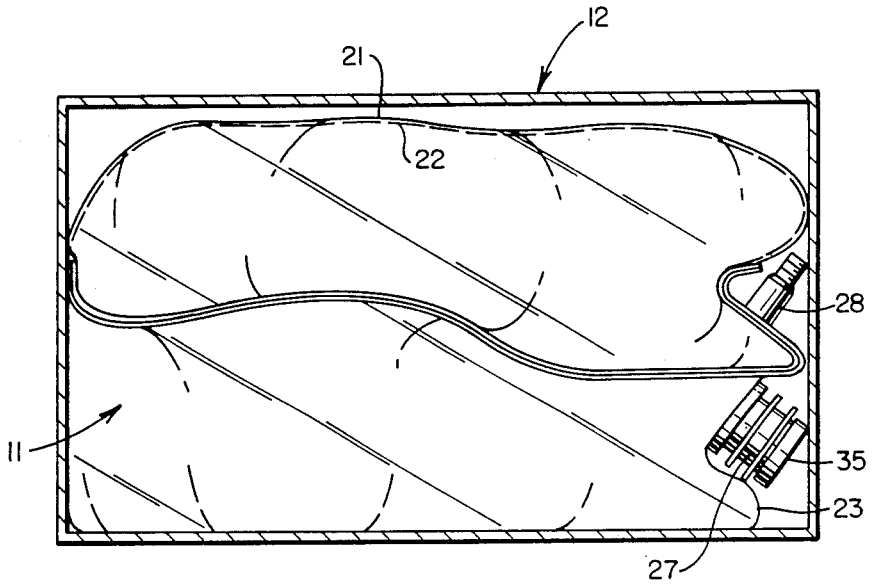
FIG. 5 is a sectional view throught the box showing the bag with its product chamber filled and expanded but its pressure-chamber not yet expanded.
Figure 8:
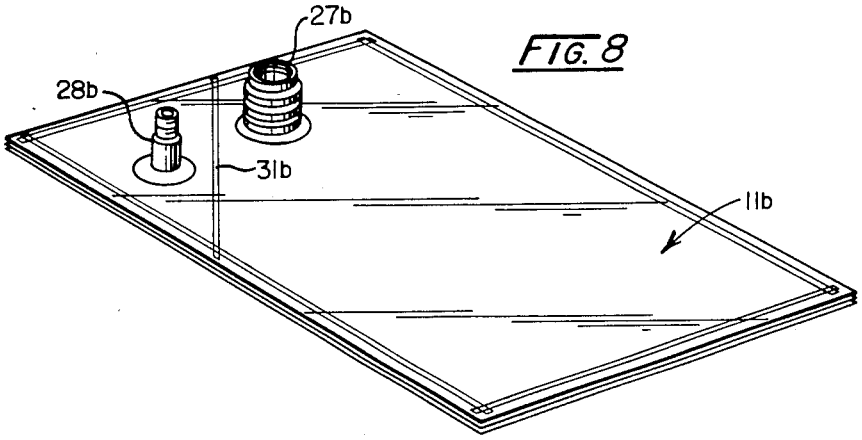
FIG. 8 is a perspective view of a modification of the bag.

The bag 11 itself, as indicated, is composed of three plies of plastic film and examples of it are shown in FIGS. 2 and 3 and in FIG. 8. These films are sealed together at their peripheral edges. Each ply consists of one or more layers of mono- or multi-layer film. The bag is shown rectangular in form, but is not limited to that shape. Each ply is preferably a laminate and the bag formed according to this invention will consist of an outer laminate 21 which forms an outer product wall, an intermediate laminate 22 which forms a baffle wall, and another outer laminate 23 which forms a displacement outer wall. The two plies which come into contact with the product, that is plies 21 and 22, are each preferably of a laminate which consists of one inner barrier layer with outer layers of polyolefin, preferably polyethylene. The barrier layer may be of nylon or EVOH or a metalized polyester film. The outer displacement wall ply 23 which never comes into contact with the product may optionally be nothing more than polyethylene. When the bag is expanded from its flat manufactured state, two separate chambers are produced, namely, the product chamber 25 and the pressure chamber 26 as shown in FIG. 6 and as also indicated before bag expansion in FIG. 3.

Coupling fitments are provided on the bag for providing independent connections with the respective chambers 25 and 26. These fitments as shown in FIG. 3 take the form of a product filling and dispensing coupling spout 27 and a pressure-fluid receiving coupling sleeve 28. As previously indicated, and as shown in copending application Ser. No. 89,642, the fitments may be on the opposite outer plies 21 and 23 but are preferably on the same side longitudinally spaced to facilitate manufacture, being shown on the outer ply 21. It will be apparent from FIG. 3 that the spout 27 is mounted in an opening in the outer wall 21 and communicates directly with the product chamber 25 for filling it and and permitting flow therefrom. It has an inner flange 24 which is heat-sealed within and to the wall 21. The pressure fitting 28 is in the form of a threaded sleeve which has a flange 30 that is heat sealed between the wall 21 and the intermediate wall 22, its inner end being normally closed by wall 22 which can be pierced at 22*a* when the sleeve 28 is to function to communicate with pressure chamber 26 or in manufacture. It will be noted that there is a cross heat seal seam 31 between walls 21 and 22 which extends completely across the bag between the fittings 27 and 28 so that pressure fitting 28 can communicate with pressure chamber 26 but not product chamber 25. Instead of a heat seal seam 31 extending transversely completely across the bag, a heat seal 31*b* may be provided as shown on the bag 11*b* in FIG. 8 between the fittings 28*b* and 28*b* so they will have independent communication with the respective product and pressure chambers of the bag. In this instance, the fittings 27*b* and 28*b* will be side-by-side instead of longitudinally spaced as in FIG. 2.

The product chamber 26 of the bag 11 may be filled by the usual filling machines through the spout 27 and may be sealed by any suitable closure or cap 35 (FIG. 5) applied to the spout. The bag filled with product may then be placed in any suitable fiberboard box 12 as indicated in FIG. 11.

To dispense the product from the filled product chamber, the spout 27 may be slipped through a keyhole opening 27a in the adjacent end of the box, which may be like that disclosed in U.S. Pat. No. 3,173,579, and may be dispensed through a suitable valve and service line connector unit 36 which may be of various types, such as that described in U.S. Pat. No. 4,421,146. Pressure fitting 28 is accessed from the box in the same manner. To aid in dispensing of the viscous or semi-viscous product which will not readily flow, pressure is introduced into the pressure chamber 26 through the fitting 28. This pressure may be from a low pressure air source or water from the usual water tap regulated to low pressure. For this purpose, the fitting 28 will be passed through an opening 28*a* in the adjacent end of the box and have the low pressure supply line 37 connected thereto.

The line 37 may have a coupling 38 on its end which will screw onto the pressure fitment 28. This coupling, as shown in FIG. 3A, may have a sharp probe 39 which, as it enters the fitment 28, will pierce the seal at 22*a*. If the seal 22*a* is removed during manufacture of the bag, the probe 39 will not be needed.

The pressure will cause the pressure chamber 26 to gradually expand substantially into the condition illustrated in FIG. 6 where the baffle wall 22 will exert a desired pressure on the product in chamber 25 to cause it to dispense through spout 27.

Since the ordinary fiberboard box of bag-in-box packages can usually withstand pressures of only 1 to 2 PSI, it is necessary to reinforce the box 12 during dispensing under pressure from expansion of the pressure chamber 26. This is accomplished by use of a pressure-resisting enclosure of a suitable type such as that shown at 13 in FIGS. 1, 4, and 6.

The box enclosure 13 may take various forms, but it is shown herein as a cage-like metal structure, so it can be made at a low cost. However, it could be of solid, lightweight construction, or even be molded from plastic. Cages would usually be built in modules of four and serve the dual purpose of a box used in gravity dispensing. As shown, it may be of a series of square metal tubes welded together. It consists of end squares 40 and 41 held in longitudinally spaced relationship by the longitudinal tubes 42. The closed end is provided with vertical tubes 43 and a cross tube 44, and the other end is provided with a gate structure for the square open end 41. This end will permit insertion. of the box 12. The gate structure consists of a pair of vertical tubes 45 and a horizontal tube 46 crossed and welded together. The members 45 are hinged at 47 at their lower ends. All the tubes are sufficiently close to support the respective walls against rupture by the pressure. A removable reinforcing plate 48 may be provided within the gate structure which has openings 27*c* and 28*c* (FIGS. 1 and 6) through which the respective fittings 27 and 28 may be passed when the box 12 is inserted in the cage or enclosure 13. The gate structure may be held closed by bolts 49 having wing type heads for hand operation.

When it is desired to dispense the product, the filled bag 11 in the box 12 (FIG. 5) is inserted into the enclosure 13 by opening the gate and removing the plate 48. The fitments 27 and 28 are pulled through the respective openings 27*a* and 28*a* in the plate and then the plate is positioned at the end of the box and held in that position by closing and securing the gate. Thereafter, the pressure line 37 is connected to the fitting 28 by coupling 38 which pierces seal 22*a* if it is in place and the dispensing unit 36 is connected to the spout 27. The cage 13 is preferably inclined slightly to hold the box inclined toward the spout 27 by the downwardly extending legs of tubes 43. An angle of about seven degrees has been found suitable. Pressure applied through the fitment 28 will enter the pressure chamber 26 to expand it as indicated in FIG. 6 substantially to the contour of the box and exert through the baffle wall 22 a pressure on the product in the product chamber 25 to force it to flow towards the spout 27. This pressure can be continued until all of the product has been discharged or until only a portion of the product has been discharged. When completely discharged, the box may be removed from the enclosure 13 and may be discarded.

Thus, with this arrangement the flow of the viscous or semi-viscous product in the product chamber 25 can be greatly increased by the pressure created in the pressure chamber 26. This pressure can be maintained by a check valve in the line 37 and is preferably regulated by a low pressure regulator of the usual type associated with that valve.

The special bag 11 of this invention may be manufactured as indicated in FIG. 7. This method is generally similar to that disclosed in FIG. 12 of U.S. Pat. No. 4,601,410. A continuous strip 50 of the bags may be produced with fitments 27 and 28 at the upper side of the strip. For the sake of simplicity a roll of a single web 21*a* is shown to form the outer product wall 21, a roll of a single web 22*a* is shown to form the product baffle wall 22, and a roll of a single web 23*a* is shown to form the displacement outer wall 23. These webs are advanced to successive stations for certain operations. The web 21*a* is pulled intermittently, horizontally from its roll at an upper location above the webs 22*a* and 23*a* which are pulled intermittently from their respective rolls. Web 22*a* travels vertically around a lower guide roll 51 to an upper guide roll 52 where it is directed closely beneath the horizontally moving web 21*a*. Web 23*a* travels vertically around a lower guide roll 53 to an upper guide roll 54 where it is directed horizontally closely beneath the webs 21*a* and 22*a*.

The web 21*a* after being pulled under tension from its roll is subjected at one station to punch units 55 and 56 of a common type which are activated simultaneously to produce holes for receiving the respective fitments 27 and 28. The web 21*a* is moved to another station where units 57 and 58 of a common type insert fitments 27 and 28 into the respective holes in the web 21*a*. Each of these units includes a lower cylinder and piston unit which inserts the fitment into their respective holes and upper units which seals their flanges to the web 21*a*. As the web 21*a* is moved toward the next station, the web 22*a* is positioned closely beneath it and the superimposed webs 21*a* and 22*a* move to the next station into cooperation with the units 59 and 60 which operate simultaneously. The unit 59 is of a common type and produces the heat seal seam 31 of the bag completely across the strip between the fitments 27 and 28. The unit 60 is of such a type that it seals the under side of flange 30 of fitment 28 to web 22*a* to the condition shown in FIG. 3. The sealed-together webs 21*a* and 22*a* move on to another station into an edge heat sealing unit 61 of a common type and as they move into that unit, the web 23 moves closely beneath them after passing horizontally over the guide roller 54. This unit will heat seal the edges of the three webs 21*a*, 22*a*, and 23*a* together.

These combined webs are then moved on to another station consisting of an end sealing unit 62 which is of the usual type that has double sealing means 63 and 64 for producing a dual seal transversely across the webs 21*a*, 22*a* and 23*a*. Then the combined webs move to a unit 65 which will provide a perforated tear line between the dual end seams so that the bags will still be in the form of a strip 50. However, the unit 65 could be a cutter to cut individual bags from the strip.

Thus the fitments 27 and 28 will be at the upper side of the strip 50 of bags and will have the transverse seal 31 between the longitudinally spaced fitments. If it is desired to have the fitments 27*b* and 28*b* of the bag 11*b*, shown in FIG. 8, side-by-side, the unit 59 can be modified to produce the angular seam 31*b* extending from end to side at a corner of the bag. The fitments can be in other positions and a similar seam can be used between them to separate their functions.

If it is desired to break the 22*a* membrane across the inner end of pressure fitment 28 during the manufacture of the bag, the arrangement shown in FIG. 7A can be used which is a modification of units 60. This modified unit 60*a* has its lower heating element 62 provided with an upwardly movable piercing tool 63 which will normally be below the combined plies 21*a* and 22*a*. When the fitment 28 is moved into position over the tool, the tool is activated to move upwardly and pierce the layer 22*a* simultaneous to sealing the flange 30 of fitment 28 to web 22*a*.

It will be apparent that this invention provides a bag-in-box package which can receive a product which will not readily flow by gravity such as a viscous or semi-viscous product but that can be readily dispensed therefrom under pressure according to this invention. However, the shipping container need not necessarily be a box as long as it can resist the dispensing pressure. Also, as indicated, the bag itself could be enclosed within an enveloping rack compartment for dispensing. The three-ply bag is of novel form with separate product and pressure chambers that are independently connected to a product fitment and a pressure fitment. The special bag can be readily manufactured by a novel method provided by this invention.

Having thus described this invention, what is claimed is:

1. A disposable flexible bag for packaging a product which will not readily flow by gravity comprising at least three plies of flexible material sealed together at their peripheral edges, the plies forming an outer product wall, an intermediate product baffle wall, and an outer displacement wall, thereby providing a product-receiving chamber and a pressure-receiving chamber which are independent of each other, and coupling fitments comprising product and pressure fitments connected independently to the respective chambers, said fitments being mounted on one of said outer walls, and a sealing seam between the fitments which seals the outer wall on which they are disposed to the inner baffle wall so that the product fitment communicates with the product chamber and the pressure fitment communicates with the pressure chamber independently.

2. A bag according to claim 1 in which the pressure fitment is extended through an opening and sealed to the outer product wall and is sealed to the intermediate product baffle wall which is pierced at the seal when the pressure fitment is to be used.

3. A bag according to claim 2 in which the seal is pierced during manufacture of the bag.

4. A bag according to claim 2 in which the fitments are at one side of the bag in spaced relationship, and the sealing seam extends between the fitments.

5. A bag according to claim 4 in which the fitments are at one side of the bag in longitudinally spaced relationship and the seam extends transversely across the bag between the fitments.

6. A bag according to claim 4 in which the fitments are at one side of the bag in laterally spaced relationship and the seam extends between the fitments.

7. A bag according to claim 2 in which the product fitment is a coupling spout through which the product chamber may be filled and dispensed, and the pressure fitment is a coupling sleeve adapted to be connected to a source of fluid under pressure.

8. In combination with the bag of claim 2, a protective compartment for receiving the filled bag with means for exposing the fitments for pressurizing the pressue chamber through the pressure fitment and dispensing the product from the product chamber.

9. The combination of claim 8 in which the compartment is a fiberboard box.

10. The combination of claim 9 including means connected to the pressure fitment for supplying and maintaining a predetermined low pressure in the pressure chamber to cause it to expand substantially to the contour of the box and act on the product chamber through the baffle wall to aid in dispensing the product through the product fitment.

11. The combination of claim 10 including a pressure-resisting enveloping unit for receiving the box to resist the pressure exerted on its walls during dispensing.

12. The combination of claim 11 in which the enveloping unit is of a form complemental to the box and has a gate structure which can be opened to receive the box.

13. The combination of claim 12 in which the fitments extend through holes in the box located at the gate structure, and a pressure-resisting plate associated with the gate structure through which the fitments are passed.

14. The combination of claim 13 in which the enveloping unit is of cage-like form with the gate structure at one end and has means which causes it to tilt toward that end.

15. A disposable flexible bag comprising at least three plies of flexible material sealed together at their peripheral edges, the plies forming a first outer wall, an intermediate baffle wall, and a second outer wall, thereby providing two chambers which are independent of each other, and coupling fitments connected independently to the respective chambers; said fitments being mounted on one of said outer walls, and a sealing seam between the fitments which seals the outer wall on which they are disposed to the inner baffle wall so that the fitments communicate with the respective chambers independently.

16. A bag according to claim 15 in which one fitment is extended through an opening in one of said outer walls and is sealed thereto and is also sealed to the intermediate product baffle wall which is pierced at the seal when that fitment is to be used.

17. A bag according to claim 16 in which the seal is pierced during manufacture of the bag.

18. A bag according to claim 16 in which the fitments are at one side of the bag in spaced relationship, and the sealing seam extends between the fitments.

19. A bag according to claim 18 in which the fitments are at one side of the bag in longitudinally spaced relationship and the seam extends transversely across the bag between the fitments.

20. A bag according to claim 18 in which the fitments are at one side of the bag in laterally spaced relationship and the seam extends between the fitments.

21. In combination with the bag of claim 15, a protective compartment for receiving the filled bag with means for exposing the fitments for use.

22. The combination of claim 21 in which the compartment is a fiberboard box.

23. The combination of claim 22 including a protective enveloping unit for receiving the box to resist pressure exerted on its walls during use.

24. The combination of claim 23 in which the enveloping unit is of a form complemental to the box and has a gate structure which can be opened to receive the box.

25. The combination of claim 24 in which the fitments extend through holes in the box located at the gate structure, and a protective plate associated with the gate structure through which the fitments are passed.

26. The combination of claim 25 in which the enveloping unit is of cage-like form with the gate structure at one end and means which causes it to tilt toward that end.

* * * * *